United States Patent [19]

Rethmeier et al.

[11] Patent Number: 4,910,895

[45] Date of Patent: Mar. 27, 1990

[54] STEAM IRON PUMP MECHANISM

[75] Inventors: Roel A. Rethmeier, Groningen, Netherlands; Mindert Kats, Singapore, Singapore

[73] Assignee: U.S. Philips Corp., New York, N.Y.

[21] Appl. No.: 377,779

[22] Filed: Jul. 10, 1989

Related U.S. Application Data

[63] Continuation of Ser. No. 274,090, Nov. 18, 1988, abandoned.

[30] Foreign Application Priority Data

Dec. 3, 1987 [NL] Netherlands ..... 8702907

[51] Int. Cl.[4] ..... D06F 75/06

[52] U.S. Cl. ..... 38/77.83; 38/77.5; 137/512.4; 417/566

[58] Field of Search ..... 38/77.82, 77.8, 77.81, 38/77.83, 77.5; 137/52.4, 853, 854, 493; 417/566, 571

[56] References Cited

U.S. PATENT DOCUMENTS

| | | | |
|---|---|---|---|
| 3,165,843 | 1/1965 | Willman | 38/77.83 |
| 3,474,552 | 10/1969 | Swenson | 38/77.8 |
| 3,527,551 | 9/1970 | Kutik et al. . | |
| 3,889,406 | 6/1975 | Chivers et al. | 38/77.83 |
| 4,130,954 | 12/1978 | Walker | 38/77.83 |
| 4,149,328 | 4/1979 | Hammer et al. | 38/77.83 |
| 4,296,560 | 10/1981 | Schwob | 38/77.81 |
| 4,656,763 | 4/1987 | Kawasaki et al. | 38/77.8 X |

FOREIGN PATENT DOCUMENTS

| | | | |
|---|---|---|---|
| 2235192 | 10/1973 | Fed. Rep. of Germany | 38/77.83 |
| 1597800 | 9/1981 | United Kingdom . | |

*Primary Examiner*—Andrew M. Falik
*Attorney, Agent, or Firm*—Ernestine C. Bartlett

[57] ABSTRACT

A steam iron having a pump mechanism (14) comprising a piston (15), a piston chamber (16) in which the piston is capable of moving, inlet and outlet ports (17,19) for the piston chamber, a return spring (31) and a control member for moving the piston in the opposite direction so as to pump water. To obtain a simple pump mechanism in the piston chamber (16) a cup-shaped valve member (22) of a resilient material includes a delivery valve (24) formed by two flexible wall portions (25, 26) of the valve member, the wall portions separating in the event of overpressure in the piston chamber so as to form a slitted aperture (27), the valve member further having a flexible wall portion (28) which flexibly bears against a wall (29) of the piston chamber and acts as a suction valve. The pump mechanism is preferably located in the steam needle with the object of pumping an extra quantity of water to the steam chamber (steam surge).

4 Claims, 2 Drawing Sheets

STEAM IRON PUMP MECHANISM

This is a continuation of application Ser. No. 274,090, filed on Nov. 18, 1988 abandoned.

BACKGROUND OF THE INVENTION

The invention relates to a steam iron having a shell, a sole plate, a heating element, a water reservoir, a steam chamber, a steam needle for the inflow of water from the water reservoir into the steam chamber, and a pump mechanism comprising a pump piston, a piston chamber in which the piston can move, inlet and outlet ports for the piston chamber, a return spring and a control element for moving the piston in the opposite direction so as to pump water from the pump reservoir.

Such a steam iron is disclosed in U.S. Pat. No. 3,165,843. This prior art steam iron has a pump mechanism by means of which a quantity of water can rapidly be pumped into the steam chamber so as to obtain a high steam production. The object thereof is to enable appropriately smooth ironing of very crinkled materials. The piston of the pump mechanism is rigidly secured to the steam needle. The piston chamber is positioned at the lowest point in the bottom of the water reservoir. The steam needle has such a profile that it combines a normal controllable steam function with a function to obtain extra steam. This means that the requirements as regards accuracy, particularly for the steam needle, are extra high, more specifically as regards a properly controllable steam production during the normal steaming operation.

SUMMARY OF THE INVENTION

The invention has for its object to provide a simple pump mechanism for a steam iron.

The steam iron according to the invention is therefore characterized in that the piston chamber accomodates a cup-shaped valve member of a resilient material provided with a delivery valve formed by two flexible wall portions o the valve member, the wall portions, in the case there is an overpressure in the piston chamber, being separated to form a slitted aperture, the valve member further having a flexible wall portion which flexibly bears on a wall of the piston chamber and acts as a suction valve. In this situation both the delivery valve and the suction valve are accomodated in a simple manner in a comparatively small body (valve member).

If the pump mechanism is used to obtain an additional quantity of steam, a further embodiment of the steam iron is characterized in that the pump mechanism is incorporated in the steam needle, which is provided with a bore constituting the piston chamber, and with two channels, one of which is a press channel between the piston chamber and the steam chamber, the other one is a suction channel between the piston chamber and the water reservoir. In contrast with the construction disclosed in U.S. Pat. No. 3,165,843 it is indeed possible in the present design to remove the steam needle in its totality from the iron and to remove any scale.

The pump mechanism can alternatively be used as a pump for a spraying device of an iron.

BRIEF DESCRIPTION OF THE DRAWINGS

The invention will now be described in greater detail by way of example with reference to an embodiment shown in the accompanying drawings.

DESCRIPTION OF THE PREFERRED EMBODIMENTS

Figure 1:
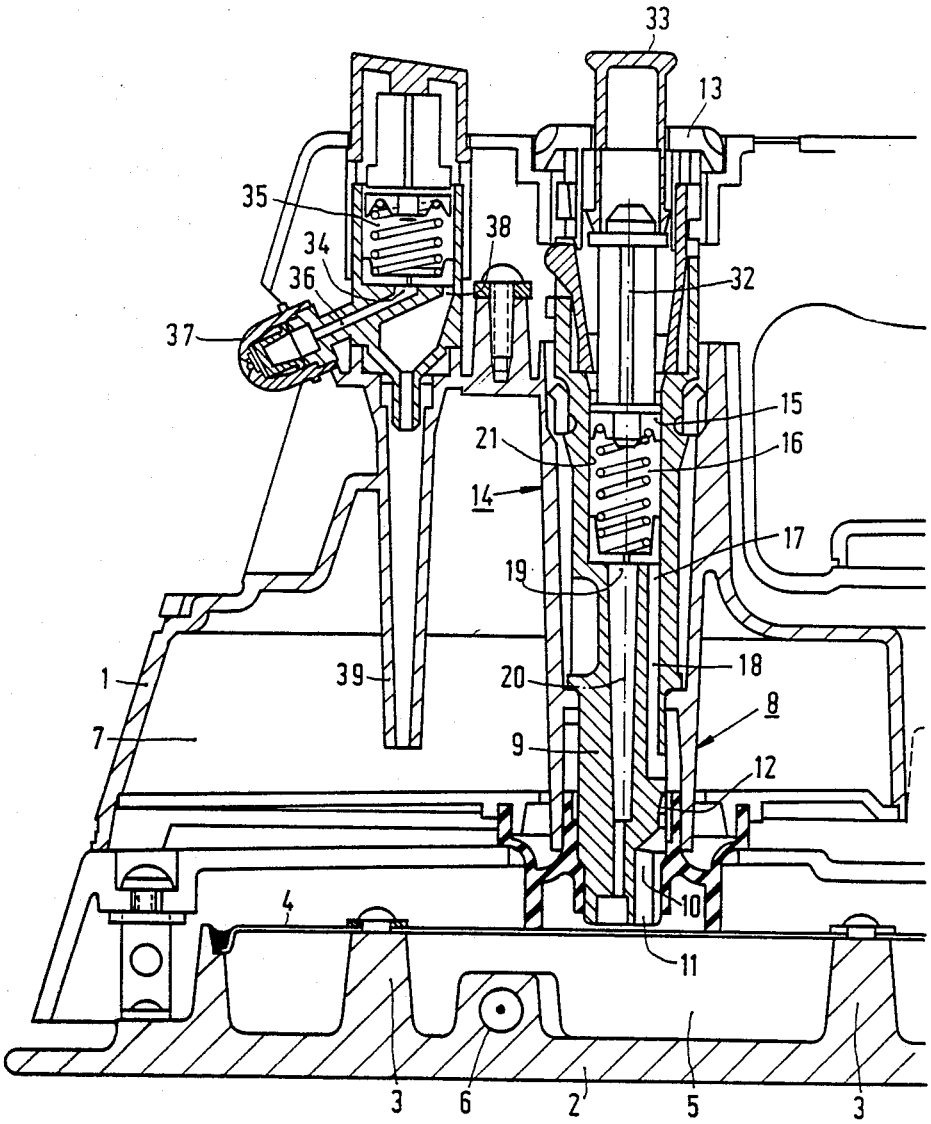
FIG. 1 is a partly cross-sectional view of a steam iron.

The steam iron is comprised of a shell 1, which at the bottom side is closed by a sole plate 2. At its interior side the sole plate is provided with positive ribs 3 to which a plate 4 is fastened such that a steam chamber 5 is formed between the interior side of the sole plate and the plate 4. The sole plate is further provided with a heating element 6 for heating the sole plate and also the steam chamber. The iron is further provided with a water reservoir 7.

A water inlet system 8 for controlling the flow from the water reservoir 7 to the steam chamber 5 includes a steam needle 9 which at its bottom side is provided with a channel 10, the channel having an outlet 11 to the steam chamber 5 and an inlet 12 to the water reservoir 7. The flow of water in the channel 10 is controllable by means of an adjusting ring 13 connected to the steam needle. The steam needle can be removed from the iron for cleaning.

The water inlet system 8 is further provided with a pump mechanism 14, by means of which an additional quantity of water can rapidly be pumped into the steam chamber 5 in order to obtain a high steam production (denoted as a steam surge). This pump mechanism includes portion 15 which can move in a piston chamber 16. The piston chamber 16 has an inlet port 17 which is connected via a channel 18 to the water reservoir 7, and an inlet port 19 which is connected to the steam chamber 5 via a channel 20. The piston chamber is in the form of a bore 21 in the steam needle 9 and the channels 18 and 20 are also incorporated in the steam needle.

Figure 2:
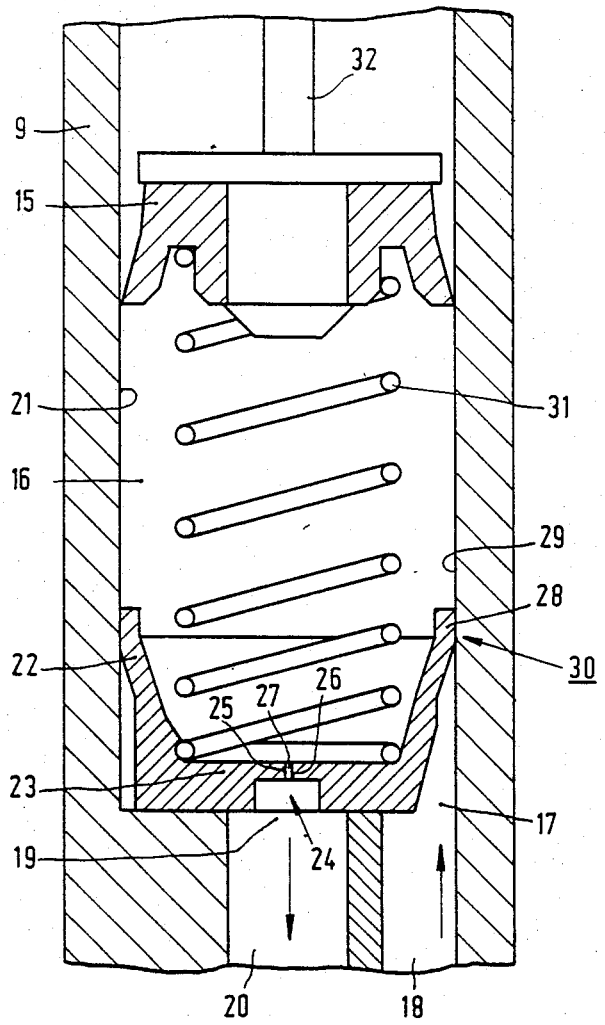
FIG. 2 shows the pump mechanism of FIG. 1 to a larger scale.

In the piston chamber 16 a cup-shaped valve member 22 made of a resilient material is located opposite the piston 15. The bottom 23 of this valve member (see FIG. 2) accommodates a delivery valve 24 formed by two facing wall portions 25 and 26, which, because they are made of a resilient material, only separate when there is an overpressure in the piston chamber (working stroke), then forming a slitted aperture 27. The delivery valve 24 is positioned opposite the outlet port 19 of the piston chamber. The upright wall portion 28 of the cup-shaped valve member 22 bears flexibly against the interior wall 29 of the piston chamber 16. To that end, the wall portion 28 becomes increasingly thinner towards its free end. When there is an underpressure in the piston chamber, the flexible wall portion gets loose from the interior wall, so that an aperture is formed between the piston chamber 16 and the inlet port 17. Consequently, the wall portion 28 acts as a delivery valve 30.

A return spring 31 is stretched between the piston 15 and the valve member 22. The piston is connected to a control knob (push button) 33 by means of a piston rod 32. Depressing the button 33 causes the piston to move down against the action of the spring 31. When the button 33 is released, the spring pushes the piston up again which produces an underpressure in the piston chamber 16 nd water is sucked into the piston chamber from the water reservoir 7 via channel 18, inlet port 17 and suction valve 30. During the upward stroke the delivery valve 24 remains closed. When the button is depressed again, an overpressure is produced in the piston chamber and the quantity of water sucked-in via the delivery valve 24, the outlet port 19 and channel 20 is pumped to the steam chamber 5. Thus, each time the button 33 is pushed, a quantity of water is pressed into the steam chamber, the water being immediately converted into steam provided the heat capacity of the sole plate has been chosen adequately high. The steam reaches the material to be ironed via outlets (not shown) in the sole plate 2.

It will be obvious that such a pump mechanism can also be used to spray water directly onto the material to be ironed. For that purpose the outlet port 34 of the piston chamber 35 is connected to a channel 36 of a sprayer 37. The inlet port 38 of the piston chamber is connected to a pipe 39 projecting into the water reservoir.

What is claimed is:

1. A steam iron having a shell, a sole plate, a heating element, a water reservoir, a steam chamber, a steam needle for the inflow of water from the water reservoir into the steam chamber, and a pump mechanism comprising a pump piston, a piston chamber in which a piston can move, inlet and outlet ports for the piston chamber, a return spring and a control element for moving the piston in the opposite direction so as to pump water from the pump reservoir, wherein the piston chamber accommodates a cup-shaped valve member of a resilient material provided with a delivery valve formed by two flexible wall portions of the valve member, the cup-shaped valve member being designed so that the wall portions, if there is an overpressure in the piston chamber, separate to form a slitted aperture, the valve member further having a flexible wall portion which flexibly bears on a wall of the piston chamber and acts as a suction valve.

2. A steam iron as claimed in claim 1, wherein the pump mechanism is incorporated in the steam needle, which is provided with a bore constituting the piston chamber, and with two channels, one of which is a press channel between the piston chamber and the steam chamber, the other one is a suction channel between the piston chamber and the water reservoir.

3. A steam iron as claimed in claim 1, wherein the outlet port of the piston chamber is connected to a sprayer via a channel.

4. A steam iron as claimed in claims 1, 2, or 3, wherein, characterized in that the return spring is arranged between the piston and the valve member.

* * * * *